US008709562B2

(12) United States Patent
Nguyen et al.

(10) Patent No.: US 8,709,562 B2
(45) Date of Patent: Apr. 29, 2014

(54) HYBRID FIBER CONSTRUCTIONS TO MITIGATE CREEP IN COMPOSITES

(75) Inventors: Huy X. Nguyen, Midlothian, VA (US); Lori L. Wagner, Richmond, VA (US)

(73) Assignee: Honeywell International, Inc., Morristown, NJ (US)

( * ) Notice: Subject to any disclaimer, the term of this patent is extended or adjusted under 35 U.S.C. 154(b) by 1212 days.

(21) Appl. No.: 11/842,477

(22) Filed: Aug. 21, 2007

(65) Prior Publication Data

US 2009/0053442 A1 Feb. 26, 2009

(51) Int. Cl.

| | |
|---|---|
| ***D03D 3/02*** | (2006.01) |
| ***D03D 13/00*** | (2006.01) |
| ***B32B 1/08*** | (2006.01) |

(52) U.S. Cl.

USPC ..... 428/36.9; 428/36.3; 428/222; 442/334

(58) Field of Classification Search

USPC ..... 428/36.3, 221, 222; 57/13, 236; 442/334

See application file for complete search history.

(56) References Cited

U.S. PATENT DOCUMENTS

| | | | | |
|---|---|---|---|---|
| 2,740,316 | A * | 4/1956 | Crossley et al. | 87/9 |
| 3,016,684 | A * | 1/1962 | Lessig | 57/295 |
| 3,434,275 | A * | 3/1969 | Backer et al. | 57/204 |
| 4,123,893 | A * | 11/1978 | Chambley et al. | 57/204 |
| 4,608,220 | A | 8/1986 | Caldwell et al. | 264/510 |
| 4,851,277 | A * | 7/1989 | Valkenburg et al. | 428/167 |
| 4,886,691 | A | 12/1989 | Wincklhofer | 428/68 |
| 4,929,503 | A * | 5/1990 | Shirasaki et al. | 428/373 |
| 5,130,193 | A * | 7/1992 | Ikeda | 428/365 |
| 5,540,990 | A | 7/1996 | Cook | |
| 5,578,374 | A | 11/1996 | Dunbar et al. | |
| 5,671,649 | A * | 9/1997 | Piotrowski et al. | 87/9 |
| 5,741,451 | A | 4/1998 | Dunbar et al. | |
| 6,601,378 | B1 | 8/2003 | Fritsch et al. | |
| 6,723,267 | B2 | 4/2004 | Simmelink et al. | |
| 6,804,942 | B2 | 10/2004 | Bryant | 57/15 |
| 6,916,533 | B2 | 7/2005 | Simmelink et al. | |
| 6,945,153 | B2 * | 9/2005 | Knudsen et al. | 87/1 |
| 6,979,660 | B2 | 12/2005 | Tam et al. | 442/108 |
| 7,127,879 | B2 | 10/2006 | Zhu et al. | 57/236 |
| 8,057,887 | B2 | 11/2011 | Morin | |
| 2005/0125036 | A1 | 6/2005 | Roby | |
| 2006/0207414 | A1 | 9/2006 | Nye | |

FOREIGN PATENT DOCUMENTS

| | | |
|---|---|---|
| EP | 1506789 | 2/2005 |
| JP | 62-149928 A | 7/1987 |
| JP | 63-295735 A | 12/1988 |
| JP | H04-108124 | 4/1992 |

OTHER PUBLICATIONS

Poursartip, Anoush, et al. "Effect of Fibre Hybridization on Creep and Stress Relaxation of Polyethylene Fibre Composites." Society for the Advancement of Material and Process Engineering, Apr. 5, 1990. 12 pp.

* cited by examiner

*Primary Examiner* — Erik Kashnikow

(57) ABSTRACT

Hybrid fiber constructions having reduced creep tendency. More particularly, twisted, low creep yarns formed by twisting together one or more high strength polyolefin fibers and one or more low creep reinforcing fibers.

20 Claims, 1 Drawing Sheet

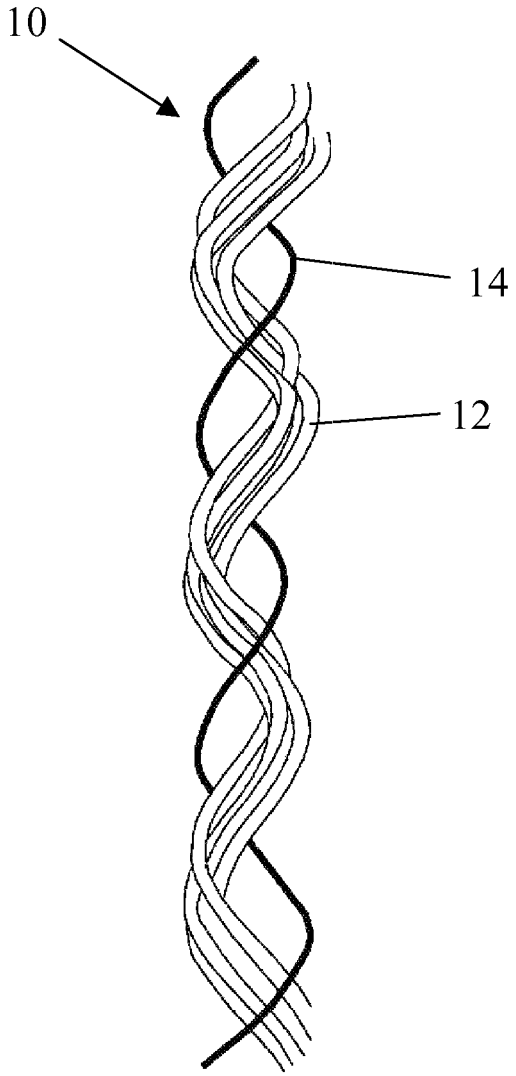
10
14
12

HYBRID FIBER CONSTRUCTIONS TO MITIGATE CREEP IN COMPOSITES

BACKGROUND OF THE INVENTION

1. Field of the Invention

This invention relates to hybrid fiber constructions having reduced creep tendency. More particularly, the invention pertains to a twisted, low creep yarn formed by twisting together one or more high strength polyolefin fibers and one or more low creep reinforcing fibers.

2. Description of the Related Art

It is preferable to use light weight, high strength fibrous reinforcements in composite applications for use in demanding environments such as sporting goods, aircraft parts, conveyor belts and for the formation of high pressure tubular structures such as pipes, hoses and other conduits. High performance thermoplastic fibers, such as polyolefin fibers, are excellent materials to form these composite structures because they have very high strength to weight performance. For example, U.S. Pat. No. 4,608,220 teaches fiber reinforced fibrous composites used for the manufacture of aircraft parts. U.S. Pat. No. 6,804,942, for example, teaches composite tubular assemblies formed from polymeric tubes that are wrapped with reinforcing fabric strips. Such high pressure tubular structures are designed to operate under extreme conditions, where they must withstand chemical and mechanical effects caused by their transport of gases and liquids.

High performance thermoplastic fibers are also known to be useful for the formation of articles having excellent ballistic resistance or cut resistance. For example, U.S. Pat. No. 6,979,660 teaches protective fabrics formed from untwisted polyethylene yarns. U.S. Pat. No. 4,886,691 teaches cut resistant articles where a less cut resistant member is surrounded by a more cut resistant jacket material. The cut resistant jacket material may be formed from yarns that include a non-twisted longitudinal polyolefin fiber strand which is wrapped by a second fiber. Accordingly, fibrous composites have been used in a variety of industries for a variety of applications.

While certain polymeric fiber types are known to have certain benefits, they are also known to have certain disadvantages. For example, while polyolefin fibers are known to have excellent strength to weight performance, it has been found that they are more susceptible to long term creep than aramid or carbon fibers. Over time, long term creep effects may result in fiber breakage and compromise the integrity of fibrous articles. In some applications, such as high pressure pipes and hoses, a compromise in the composite integrity can potentially cause significant harm to consumers, surrounding infrastructure and the environment. Nonetheless, the attractive strength to weight properties of polyolefin fibers make them highly desirable materials for such demanding applications. Accordingly, there is a need in the art for high performance composite structures formed with high strength polyolefin fibers but having a reduced creep tendency. The present invention provides a solution to this need.

SUMMARY OF THE INVENTION

The invention provides a twisted, low creep yarn, comprising a twisted combination of one or more polyolefin fibers having a tenacity of about 7 g/denier or more and a tensile modulus of about 150 g/denier or more, and one or more low creep reinforcing fibers, wherein said one or more low creep reinforcing fibers have about 3.0% or less elongation when the fiber is subjected to a stress equal to 50% of the ultimate tensile strength of the fiber for 200 hours at room temperature, as determined by the ASTM D6992 testing method.

The invention also provides an article formed from a plurality of twisted, low creep yarns, said yarns comprising a twisted combination of one or more polyolefin fibers having a tenacity of about 7 g/denier or more and a tensile modulus of about 150 g/denier or more, and one or more low creep reinforcing fibers, wherein said one or more low creep reinforcing fibers have about 3.0% or less elongation when the fiber is subjected to a stress equal to 50% of the ultimate tensile strength of the fiber for 200 hours at room temperature, as determined by the ASTM D6992 testing method.

The invention further provides a process for producing a twisted, low creep yarn, comprising:

a) providing one or more polyolefin fibers having a tenacity of about 7 g/denier or more and a tensile modulus of about 150 g/denier or more;

b) providing one or more low creep reinforcing fibers, wherein said one or more low creep reinforcing fibers have about 3.0% or less elongation when the fiber is subjected to a stress equal to 50% of the ultimate tensile strength of the fiber for 200 hours at room temperature, as determined by the ASTM D6992 testing method; and c) twisting said polyolefin fibers and low creep reinforcing fibers together at a twist ratio of at least about 0.5 twists of said one or more low creep reinforcing fibers per inch of said one or more polyolefin fibers.

BRIEF DESCRIPTION OF THE DRAWING

FIG. 1 is a perspective-view schematic representation of a twisted hybrid yarn of the invention.

DESCRIPTION OF THE INVENTION

The invention provides hybrid yarn constructions that mitigate creep in composites formed therefrom. As illustrated in FIG. 1, a hybrid yarn 10 is formed which is a twisted combination of one or more polyolefin fibers 12 and one or more low creep reinforcing fibers 14.

As used herein, a "fiber" is an elongate body the length dimension of which is much greater than the transverse dimensions of width and thickness. The cross-sections of fibers for use in this invention may vary widely. They may be circular, flat or oblong in cross-section. Accordingly, the term fiber includes filaments, ribbons, strips and the like having regular or irregular cross-section. They may also be of irregular or regular multi-lobal cross-section having one or more regular or irregular lobes projecting from the linear or longitudinal axis of the fibers. It is preferred that the fibers are single lobed and have a substantially circular cross-section. As used herein a "yarn" is a strand consisting of multiple fibers or filaments.

Polyolefin fibers 12 and low creep reinforcing fibers 14 are preferably high strength, high tensile modulus fibers. As used herein, a "high-strength, high tensile modulus fiber" is one which has a preferred tenacity of at least about 7 g/denier or more, a preferred tensile modulus of at least about 150 g/denier or more, and preferably an energy-to-break of at least about 8 J/g or more, each both as measured by ASTM D2256. As used herein, the term "denier" refers to the unit of linear density, equal to the mass in grams per 9000 meters of fiber or yarn. In the more preferred embodiments of the invention, the tenacity of the polyolefin fibers should be about 15 g/denier or more, preferably about 20 g/denier or more, more preferably about 25 g/denier or more and most preferably about 30 g/denier or more. The polyolefin fibers of the invention also have a preferred tensile modulus of about 300 g/denier or more, more preferably about 400 g/denier or more, more preferably about 500 g/denier or more, more preferably about 1,000 g/denier or more and most preferably about 1,500 g/denier or more. The polyolefin fibers of the invention also have a preferred energy-to-break of about 15 J/g or more, more preferably about 25 J/g or more, more preferably about 30 J/g or more and most preferably have an energy-to-break of about 40 J/g or more. The polyolefin fibers may be of any suitable denier, such as, for example, 50 to about 3000 denier, more preferably from about 200 to 3000 denier, still more preferably from about 650 to about 2000 denier, and most preferably from about 800 to about 1500 denier.

As used herein, the term "tenacity" refers to the tensile stress expressed as force (grams) per unit linear density (denier) of an unstressed specimen. The "initial modulus" of a fiber is the property of a material representative of its resistance to deformation. The term "tensile modulus" refers to the ratio of the change in tenacity, expressed in grams-force per denier (g/d) to the change in strain, expressed as a fraction of the original fiber length (in/in) (cm/cm).

Particularly suitable high-strength, high tensile modulus polyolefin fiber materials include high density and low density polyethylene. Particularly preferred are extended chain polyolefin fibers, such as highly oriented, high molecular weight polyethylene fibers, particularly ultra-high molecular weight polyethylene fibers, and polypropylene fibers, particularly ultra-high molecular weight polypropylene fibers. These fiber types are well known in the art. The most preferred extended chain polyethylene fibers have molecular weights of at least 500,000, preferably at least one million and more preferably between two million and five million. A particularly preferred fiber type for use in the invention are polyethylene fibers sold under the trademark SPECTRA® and manufactured by Honeywell International Inc of Morristown, N.J. Ounce-for-ounce, SPECTRA® high performance polyethylene fibers are fifteen times stronger than steel and 40% stronger than KEVLAR®, while also light enough to float on water. SPECTRA® fibers are well known in the art and are described, for example, in U.S. Pat. Nos. 4,623,547 and 4,748,064. Most preferred SPECTRA® fibers are SPECTRA® 1000 (1300 denier) fibers.

U.S. Pat. Nos. 4,413,110, 4,440,711, 4,535,027, 4,457,985, 4,623,547 4,650,710 and 4,748,064 generally discuss the formation of preferred high strength, extended chain polyethylene fibers employed in the present invention. U.S. Pat. Nos. 4,137,394 and 4,356,138, the disclosures of which are incorporated herein by reference, describe how extended chain polyethylene (ECPE) fibers may be grown in solution spinning processes. U.S. Pat. Nos. 4,551,296 and 5,006,390, the disclosures of which are incorporated herein by reference, describe how ECPE fibers may be spun from a solution to form a gel structure.

As is conventionally known, "creep" is the long-term, longitudinal deformation of a material over time when subjected to a continuing load. The creep tendency of a fiber, yarn or fabric may be determined, for example, by the Stepped Isothermal testing method (SIM) of ASTM D6992. According to ASTM D6992, the SIM is a method of exposure that uses temperature steps and dwell times to accelerate the creep response of a single specimen being tested under load. As used herein, a "low creep" reinforcing fiber preferably includes fibers that exhibit about 3.0% or less elongation, more preferably about 2.0% or less elongation, still more preferably about 1.0% or less elongation and most preferably about 0.5% or less elongation when the fiber is subjected to a stress equal to 50% of the ultimate tensile strength (UTS) of the fiber for 200 hours at room temperature. The UTS of a fiber is the maximum load the fiber can withstand before breaking. Suitable low creep reinforcing fibers 14 for use herein include carbon fibers, glass fibers, aramid (aromatic polyamide) fibers, particularly para-aramid fibers, polyester fibers such as polyethylene terephthalate and polyethylene naphthalate fibers, and combinations thereof. Each of these fiber types and methods for their manufacture are well known. Carbon fibers are commercially available, for example, from Kureha Corporation of Japan under the trademark KRECA®; from CYTEC Industries Inc. of West Paterson, N.J. under the trademark THORNEL®; and from Nippon Carbon Co. Ltd. of Tokyo, Japan. Carbon fibers are spun by standard methods for polyacrylonitrile (PAN)-based fibers. Fist polyacrylonitrile is melt spun into fibers, then the fibers are pyrolized into graphitic carbon fibers. Particular methods of their manufacture are described, for example, in U.S. Pat. Nos. 4,115,527, 4,197,283, 4,356,158 and 4,913,889, the disclosures of which are incorporated herein by reference. Preferred carbon fibers have a tensile modulus of from about 137 GPa to about 827 GPa; more preferably from about 158 GPa to about 517 GPa and most preferably from about 206 GPa to about 276 GPa.

Glass fibers are commercially available, for example, from PPG Industries of Pittsburgh, Pa., and Nippon Electric Glass Co., Ltd. Japan. See, for example, U.S. Pat. Nos. 4,015,994, 4140533, 4762809, 5064785, 5258227, 5284807, 6,139,958, 6,890,650, 6,949,289, etc., the disclosures of which are incorporated herein by reference. Preferred glass fibers have a tensile modulus of from about 60 GPa to about 90 GPa. Polyester fibers are commercially available from Performance Fibers of Richmond, Va. See, for example, U.S. Pat. Nos. 5,277,858, 5,397,527, 5,403,659, 5,630,976, 6,403,006, 6,649,263 and 6,828,021, the disclosures of which are incorporated herein by reference. Preferred polyester fibers have a tensile modulus of from about 2 g/denier to about 10 g/denier; more preferably from about 3 g/denier to about 9 g/denier and most preferably from about 5 g/denier to about 8 g/denier.

Aramid fibers are commercially available and are described, for example, in U.S. Pat. No. 3,671,542. For example, useful poly(p-phenylene terephthalamide) filaments are produced commercially by DuPont corporation under the trademark of KEVLAR®. Also useful in the practice of this invention are poly(m-phenylene isophthalamide) fibers produced commercially by DuPont under the trademark NOMEX® and fibers produced commercially by Teijin under the trademark TWARON®; aramid fibers produced commercially by Kolon Industries, Inc. of Korea under the trademark HERACRON®; p-aramid fibers SVM™ and RUSAR™ which are produced commercially by Kamensk Volokno JSC of Russia and ARMOS™ p-aramid fibers produced commercially by JSC Chim Volokno of Russia. Preferred aramid fibers have a tensile modulus of from about 60 GPa to about 145 GPa and most preferably from about 90 GPa to about 135 GPa.

In the preferred embodiments, the yarns of the invention include a bundle comprising a plurality of polyolefin fibers and/or a bundle comprising plurality of low creep reinforcing fibers, the bundles being twisted together to form a twisted, low creep yarn. For example, in a preferred embodiment, the low creep reinforcing fibers comprise one or more tows including a bundle of about 3,000 to about 12,000 individual reinforcing fibers/filaments. It is known in the art to refer to fiber bundles by the number of fibers they contain. For example, a bundle including 3,000 fibers is designated as a 3K bundle, and a bundle including 12,000 fibers is designated as a 12K bundle. Additionally, the plurality of fibers in each bundle may be twisted together as twisted bundles prior to combining the two different fiber types into a twisted hybrid yarn. This twisting enhances the interlocking of the fibers and further enhances the creep resistance of the hybrid yarns. Preferably, the polyolefin fiber bundles and the reinforcing fiber bundles are individually twisted at about one turn per inch, but they may be twisted more or less.

Various methods of twisting fibers together are known in the art. Any well known twisting method may be utilized, such as by plying. Useful twisting methods are described, for example, in U.S. Pat. Nos. 2,961,010, 3,434,275, 4,123,893 and 7,127,879, the disclosures of which are incorporated herein by reference. The standard method for determining twist in twisted yarns is ASTM D1423-02.

The twisted, low creep yarns of the invention are formed by twisting the low creep reinforcing fibers together with the polyolefin fibers at a twist ratio of from about 0.5 twists to about 5 twists of said one or more low creep reinforcing fibers per inch of said one or more polyolefin fibers, more preferably 0.75 twists to about 3 twists, and most preferably about one low creep fiber twist per inch of polyolefin fibers. In the most preferred embodiments of the invention, the low creep yarns include a greater content of the polyolefin fiber than low creep reinforcing fiber content by weight of the twisted yarn. Particularly, the twisted yarns and articles formed from the twisted yarns preferably have a low creep fiber content of from about 10% by weight to about 45% by weight of said yarns/articles, more preferably from about 15% to about 35% and most preferably from about 17% to about 30% by weight of said yarns/articles.

The hybrid yarns of the invention may be produced into woven or non-woven fabrics, or may be formed into other fibrous structures, including braided ropes or other structures. Methods of forming non-woven fabrics are well known in the art, such as by the methods described in U.S. Pat. No. 6,642,159, the disclosure of which is incorporated herein by reference. For example, the yarns may be formed into non-woven fabrics that comprise a plurality of stacked, overlapping fibrous plies that are consolidated into a single-layer, monolithic element. In this type of embodiment, each ply may comprise an arrangement of non-overlapping yarns that are aligned along a common fiber direction in a unidirectional, substantially parallel array. This type of fiber arrangement is known in the art as a "unitape" (unidirectional tape) and is referred to herein as a "single ply". As used herein, an "array" describes an orderly arrangement of yarns, and a "parallel array" describes an orderly parallel arrangement of yarns. A fiber "layer" describes a planar arrangement of woven or non-woven yarns including one or more plies. As used herein, a "single-layer" structure refers to monolithic structure composed of one fibrous ply or a plurality of fibrous plies that have been consolidated into a single unitary structure. In a particularly preferred non-woven fabric structure, a plurality of fiber plies (plurality of unitapes) are stacked onto each other wherein the parallel fibers of each single ply (unitape) are positioned orthogonally (0°/90°) to the parallel fibers of each adjacent single ply relative to the longitudinal fiber direction of each single ply. Such rotated unidirectional alignments are described, for example, in U.S. Pat. Nos. 4,457,985; 4,748,064; 4,916,000; 4,403,012; 4,623,573; and 4,737,402. The stack of non-woven fiber plies is consolidated under heat and pressure or by adhering the individual fiber plies to form a single-layer, monolithic element.

Typically, consolidation of multiple plies of non-woven fibrous plies requires that the yarns or individual fibers be coated with a polymeric binder material, also known in the art as a "polymeric matrix", to bind the yarns together. Suitable binder materials are well known in the art and include both thermoplastic and thermosetting materials. The term "coated" is not intended to limit the method by which a polymeric binder is applied onto the yarn or fiber surfaces. Accordingly, the yarns of the invention may be coated on, impregnated with, embedded in, or otherwise applied with a polymeric binder, followed by optionally consolidating the combination of the matrix material/yarns to form a composite. Consolidation can occur via drying, cooling, heating, pressure or a combination thereof Heat and/or pressure may not be necessary, as the fibers or fabric layers may just be glued together, as is the case in a wet lamination process.

Woven fabrics may be formed using techniques that are well known in the art using any fabric weave, such as plain weave, crowfoot weave, basket weave, satin weave, twill weave and the like. Plain weave is most common, where fibers are woven together in an orthogonal 0°/90° orientation. Prior to weaving, the hybrid yarns or fibers forming the yarns may or may not be coated with a polymeric binder material.

Woven or non-woven fabrics formed from the yarns of the invention may be prepared using a variety of polymeric binder (polymeric matrix) materials, including both low modulus, thermoplastic materials and high modulus, rigid materials. Suitable polymeric binder materials non-exclusively include low modulus, elastomeric materials having an initial tensile modulus less than about 6,000 psi (41.3 MPa), a preferred glass transition temperature (Tg) of less than about 0° C., more preferably the less than about −40° C., and most preferably less than about −50° C.; and a preferred elongation to break of at least about 50%, more preferably at least about 100% and most preferably has an elongation to break of at least about 300%. Suitable high modulus, rigid materials have an initial tensile modulus at least about $1\times10^6$ psi (6895 MPa), each as measured at 37° C. by ASTM D638. Examples of such materials are disclosed, for example, in U.S. Pat. No. 6,642,159, the disclosure of which is expressly incorporated herein by reference. As used herein throughout, the term tensile modulus means the modulus of elasticity as measured by ASTM 2256 for a fiber and by ASTM D638 for a polymeric binder material. A polymeric binder may be applied to a yarn of the invention in a variety of ways, and the term "coated" is not intended to limit the method by which the polymeric binder is applied onto the fiber surface or surfaces.

In accordance with the invention, to produce non-woven fabrics having low creep, such fabrics preferably include a binder quantity of from about 10% to about 80% by weight, more preferably from about 15% to about 50% by weight, and most preferably from about 20% to about 40% by weight of the total weight of the fabric. Accordingly, low creep, non-woven fabrics preferably contain a fiber content of from about 20% to about 90% by weight, more preferably from about 50% to about 85% by weight, and most preferably from about 60% to about 80% by weight of the total weight of the fabric, including binder.

The yarns and fabrics of the invention are particularly attractive for forming tubular structures, such as hoses and pipes, and as outer reinforcing sleeves of plastic pipe structures. To form tubular structures, fabrics formed from the yarns of the invention may be cut into narrow widths, helically wound onto a mandrel and then cured under suitable heat and preferably pressure. By narrow width it is meant that the fabric structure has a width of from about 1 inch to about 20 inches (2.54 cm to 50.8 cm), more preferably from about 2 inches to about 16 inches (5.08 cm to 40.64 cm), and most preferably from about 4 inches to about 16 inches (10.16 cm to 40.64 cm). Smaller diameter tubular structures are generally formed from narrower fabric composites. The fabric on the mandrel may be heated for between about 2 to about 24 hours at a temperature of from about 220° F. to 280° F. (about 104° C. to 138° C.), more preferably for between about 4 hours to about 8 hours at a temperature of from about 220° F. to about 240° F. (about 104° C. to about 116° C.). The pressure may range from about 100 psi to about 150 psi (about 689 kPa to about 1033.5 kPa). The resultant hose is then removed from the mandrel.

When winding the fabric structure over the mandrel, each successive layer may, for example, overlap the previous layer by a desired amount, such as from about 15% to about 75% of the width of the previous layer, more preferably about one-half of the width of the previous layer. It should be understood that other overlapping distances (or no overlap) may be employed. When helically winding the composite fabric, a winding angle of from about 40 degrees to about 60 degrees is preferred. To achieve the maximum burst strength of the tubular structure the winding angle should be about 57 degrees. To achieve further strength in the tubular structure, the composite fabric may initially be wound on the mandrel in one direction, and then overlapped by winding the composite fabric in the opposite direction. The resultant tubular structure may be used by itself as a pipe, hose or conduit or the like. These structures are preferably flexible. They may be employed in a variety of applications, such as for high or low pressure gas transmission, transmission of corrosive chemicals, oil and other petroleum products, water, waste products, and the like. Fabrics formed from the hybrid yarns of the invention are particularly well resistant to a variety of chemicals.

Another use for the tubular structures of the invention is as a covering or liner for existing pipe or hose. Such pipe may be formed of metal, plastic or composite. The chemical resistance of the fibrous networks again permits the transmission of chemicals, including corrosive chemicals, through the pipe structure and minimizes any damage to the existing pipe or hose. A pipe structure which includes a covering of high tenacity polyolefin fibers is disclosed in co-pending U.S. patent application Ser. No. 11/228,935, filed Sep. 16, 2005, the disclosure of which is incorporated herein by reference to the extent not inconsistent herewith. For example, yarns or fabrics of the invention may be applied to a pipe by winding the yarns or fabrics in a helical manner about the outer surface of the pipe. The pipe may initially be wound with a fabric of the invention in one direction, and then overlapped by winding the fabric in the opposite direction. When winding the fabric over the pipe, each successive layer may, for example, overlap the previous layer by about one-half of the width of the previous layer. When helically winding the fabric, a winding angle of from about 40 to about 60 degrees is preferred, with a winding angle of about 57 degrees being most preferred to achieve the maximum burst strength. Such a fabric covering would preferably not be adhered to the outer surface of the pipe, merely overlying the outer surface so that it is free to move over the outer surface. Alternatively, the fabric covering may be adhered to the outer surface of the pipe by any suitable adhesive. Examples of adhesives that may be employed in this invention include thermoplastic and thermosetting adhesives, either in resin or cast film form. Such adhesives include pressure sensitive adhesives, high elongation urethanes, flexible epoxies, and the like.

The following examples serve to illustrate the invention.

INVENTIVE EXAMPLE 1

The creep rupture time, i.e. the time it takes for a fabric sample to break under a constant creep load (constant load, free elongation), of a 1.5 inch (3.81 cm) wide fabric strip formed from hybrid yarns consisting of three SPECTRA® 1000, 1300 fiber tows twisted together with one 3K tow of carbon fiber (tensile modulus=228 GPa (83% SPECTRA® 1000, 1300 denier by weight; 17% carbon fiber by weight) was measured according to the Stepped Isothermal testing method (SIM) of ASTM D6992 at 30% of the ultimate tensile strength of the fabric. The 3K carbon tow was twisted at 1 turn per inch of length of the combined SPECTRA® tow. The fabric strip was measured to have a ultimate tensile strength of 987 lb/in. (176.28 kg/cm). The sample lasted 44,500 hours according to ASTM D6992.

INVENTIVE EXAMPLE 2

Inventive Example 1 was repeated, except the fabric strip was subjected to a creep load of 493.5 lb/in. (88.14 kg/cm) (measured at 50% UTS according to ASTM D6992). This sample lasted 11,076 hours, according to ASTM D6992.

INVENTIVE EXAMPLE 3

Inventive Example 1 was repeated, except the fabric strip was subjected to a creep load of 789.6 lb/in. (141.02 kg/cm) (measured at 80% UTS according to ASTM D6992). This sample lasted 615 hours, according to ASTM D6992.

INVENTIVE EXAMPLE 4

Inventive Example 1 was repeated, except the fabric strip was subjected to a creep load of 888.3 lb (158.65 kg/cm) (measured at 90% UTS according to ASTM D6992). This sample lasted 209 hours, according to ASTM D6992.

COMPARATIVE EXAMPLE 1

The creep rupture time of a 2 inch (5.08 cm) wide strip of SPECTRA® fabric style 973 (8×8 basket weave, 48 tows of SPECTRA® 1000, 1300 denier fibers per inch of fabric in length and in width); UTS=3659 lb/in (653.5 kg/cm); woven by Hexcel Corporation of Stamford, Conn.) was measured according to the SIM method of ASTM D6992 at 50%, 80% and 90% of the ultimate tensile strength of the fabric. The creep rupture times were 77 hours, 2 hours and 0.02 hour, respectively.

COMPARATIVE EXAMPLE 2

The creep rupture time of a 2 inch wide strip of KEVLAR® fabric style 704 (31×31, plain weave KEVLAR® 129, 840 denier fibers, UTS=900 lb per inch (160.74 kg/cm), woven by Hexcel Corp. was measured according to the SIM method of ASTM D6992 at 50%, 80% and 90% of the ultimate tensile strength of the fabric. The creep rupture times were 13,300 hours, 4 hours and 0.02 hour, respectively.

COMPARATIVE EXAMPLE 3

The creep rupture time of a one-inch strip of a multi-ply hybrid comprising a layer of SPECTRA® fabric style 973 and a layer of 5.7 oz/yd$^2$ carbon fabric stitched together through the thickness (carbon fiber content of 25% by weight; UTS=1522 lb/inch (271.83 kg/cm)) was measured according to the SIM of ASTM D6992 at 80% of the ultimate tensile strength of the fabric. The creep rupture time was 1 hour.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A woven fibrous article formed from a plurality of twisted, low creep yarns, said yarns comprising a twisted combination of one or more polyolefin fibers having a tenacity of about 7 g/denier or more and a tensile modulus of about 150 g/denier or more, and one or more low creep reinforcing fibers, which fibers are twisted together at a twist ratio of at least about 0.5 twists of said one or more low creep reinforcing fibers per inch of said one or more polyolefin fibers, and wherein said one or more low creep reinforcing fibers have about 3.0% or less elongation when the fiber is subjected to a stress equal to 50% of the ultimate tensile strength of the fiber for 200 hours at room temperature, as determined by the ASTM D6992 testing method.

2. The article of claim 1 wherein said one or more low creep reinforcing fibers comprise carbon fibers.

3. The article of claim 1 which has a tubular structure.

4. The article of claim 1 wherein the low creep reinforcing fibers are twisted with the polyolefin fibers at a twist ratio of from about 0.5 twists to about 3 twists of said one or more low creep reinforcing fibers per inch of said one or more polyolefin fibers.

5. The article of claim 1 wherein the low creep reinforcing fibers are twisted with the polyolefin fibers at a twist ratio of about one twist of said one or more low creep reinforcing fibers per inch of said one or more polyolefin fibers.

6. The article of claim 1 which further comprises a polymeric binder material coated on said plurality of twisted, low creep yarns.

7. The article of claim 1 which comprises a consolidated plurality of overlapping, woven fibrous plies, each fibrous ply comprising a plurality of said twisted, low creep yarns which are coated with a polymeric binder material comprising a thermosetting polymer.

8. The article of claim 3 further comprising a pipe or a hose, wherein said tubular structure comprises a covering for the pipe or hose, or a liner for the pipe or hose.

9. A non-woven fibrous article comprising at least one ply or layer comprising substantially parallel yarns, said non-woven fibrous article being formed from a plurality of twisted, low creep yarns, said yarns comprising a twisted combination of one or more polyolefin fibers having a tenacity of about 7 g/denier or more and a tensile modulus of about 150 g/denier or more, and one or more low creep reinforcing fibers, which fibers are twisted together at a twist ratio of at least about 0.5 twists of said one or more low creep reinforcing fibers per inch of said one or more polyolefin fibers, and wherein said one or more low creep reinforcing fibers have about 3.0% or less elongation when the fiber is subjected to a stress equal to 50% of the ultimate tensile strength of the fiber for 200 hours at room temperature, as determined by the ASTM D6992 testing method.

10. The article of claim 9 wherein said one or more low creep reinforcing fibers comprise carbon fibers.

11. The article of claim 9 which has a tubular structure.

12. The article of claim 11 further comprising a pipe or a hose, wherein said tubular structure comprises a covering for the pipe or hose, or a liner for the pipe or hose.

13. The article of claim 9 wherein the low creep reinforcing fibers are twisted with the polyolefin fibers at a twist ratio of from about 0.5 twists to about 3 twists of said one or more low creep reinforcing fibers per inch of said one or more polyolefin fibers.

14. The article of claim 9 wherein the low creep reinforcing fibers are twisted with the polyolefin fibers at a twist ratio of about one twist of said one or more low creep reinforcing fibers per inch of said one or more polyolefin fibers.

15. The article of claim 9 wherein said article has a low creep fiber content of from about 17% by weight to about 30% by weight of said article.

16. The article of claim 9 which further comprises a polymeric binder material coated on said plurality of twisted, low creep yarns.

17. The article of claim 9 which comprises a consolidated plurality of overlapping, non-woven fibrous plies, each fibrous ply comprising a plurality of said twisted, low creep yarns coated with a polymeric binder material comprising a thermosetting polymer.

18. A twisted, low creep yarn, comprising a twisted combination of one or more polyolefin fibers having a tenacity of about 7 g/denier or more and a tensile modulus of about 150 g/denier or more, and one or more low creep reinforcing fibers, which fibers are twisted together at a twist ratio of at least about 0.5 twists of said one or more low creep reinforcing fibers per inch of said one or more polyolefin fibers, and wherein said one or more low creep reinforcing fibers have about 3.0% or less elongation when the fiber is subjected to a stress equal to 50% of the ultimate tensile strength of the fiber for 200 hours at room temperature, as determined by the ASTM D6992 testing method.

19. The twisted, low creep yarn of claim 18 wherein the low creep reinforcing fibers comprise carbon fibers and are twisted with the polyolefin fibers at a twist ratio of from about 0.5 twists to about 3 twists of said one or more low creep reinforcing fibers per inch of said one or more polyolefin fibers.

20. The twisted, low creep yarn of claim 18 which further comprises a polymeric binder material coated on said plurality of twisted, low creep yarns.

* * * * *